United States Patent [19]

Harrington et al.

[11] Patent Number: 4,629,592

[45] Date of Patent: Dec. 16, 1986

[54] METHOD AND APPARATUS UTILIZING INFLATABLE MEMBRANE FORM FOR CONSTRUCTION OF CONCRETE SHELL BUILDING

[76] Inventors: Horrall Harrington, 613 Berlin Rd., Pittsburgh, Pa. 15221; Phillip J. Vittore, 1306 W. Noyes, Arlington Heights, Ill. 60005

[21] Appl. No.: 821,287

[22] Filed: Jan. 22, 1986

[51] Int. Cl.[4] ..... B28B 7/32; E04G 11/04

[52] U.S. Cl. ..... 264/32; 52/2; 52/741; 249/19; 249/65; 264/314

[58] Field of Search ..... 264/32, 314; 249/19, 249/65; 52/2, 741

[56] References Cited

U.S. PATENT DOCUMENTS

| | | | |
|---|---|---|---|
| 2,388,701 | 11/1945 | Neff . | |
| 3,059,655 | 10/1962 | Bird . | |
| 3,355,851 | 12/1967 | Imbertson et al. . | |
| 3,619,432 | 11/1971 | Harrington | 264/32 |
| 3,643,910 | 2/1972 | Heifetz | 249/65 |
| 3,719,341 | 3/1973 | Harrington | 249/65 |
| 3,930,344 | 1/1976 | Gahler | 52/2 |
| 3,975,915 | 8/1976 | Haw | 52/2 X |
| 4,051,638 | 10/1974 | Heintz | 52/63 |
| 4,192,112 | 3/1980 | Reilly, Sr. | 52/222 |
| 4,307,554 | 12/1981 | Morrison et al. | 52/741 |
| 4,365,455 | 12/1982 | Braine | 52/741 |

FOREIGN PATENT DOCUMENTS 2118608 11/1983 United Kingdom ..... 249/65

OTHER PUBLICATIONS

*Public Works Magazine*, "Inflatable Form Shapes Concrete Salt Dome Storage", 10-1978.

*Farm Chemicals*, "Chevron Goes Dome for Economy, Efficiency", 5-1982 .

*Primary Examiner*—Jan Silbaugh

*Attorney, Agent, or Firm*—Kinzer, Plyer, Dorn & McEachran

[57] ABSTRACT

A method and apparatus for anchoring an inflatable membrane form to the base wall of a building to be covered by a concrete shell incorporates a groove formation at the top inner face of the building base wall, the groove formation comprising a horizontal shelf of width W1, a recess of height H1 and width W2, and a vertical wall segment of height H2. The edge portion of an inflatable membrane form is wrapped in a multiplicity of elongated wood rail members of height H3 and width W3, with H3<H1 and W1>W3>W2, and the rails are inserted into the groove formation recess. A multiplicity of elongated steel retainer plates of flat, open, C-shaped cross-sectional configuration, mounted on bolts projecting from the shelf portion of the groove formation, aid in holding the wrapped rails and form edge in place when the form is inflated.

11 Claims, 6 Drawing Figures

Fig. 3.
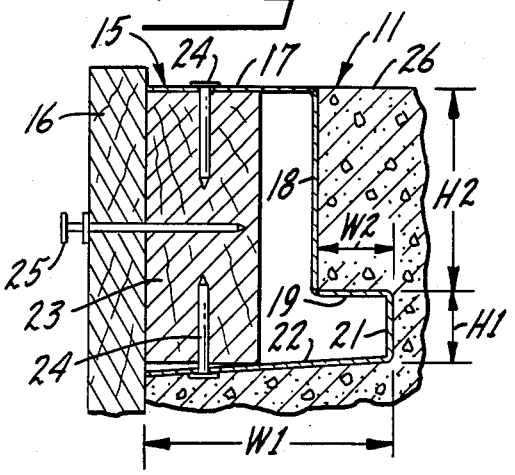
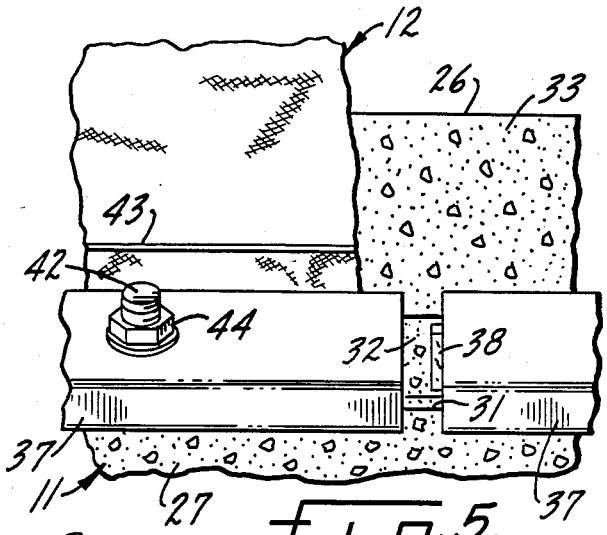
Fig. 5.
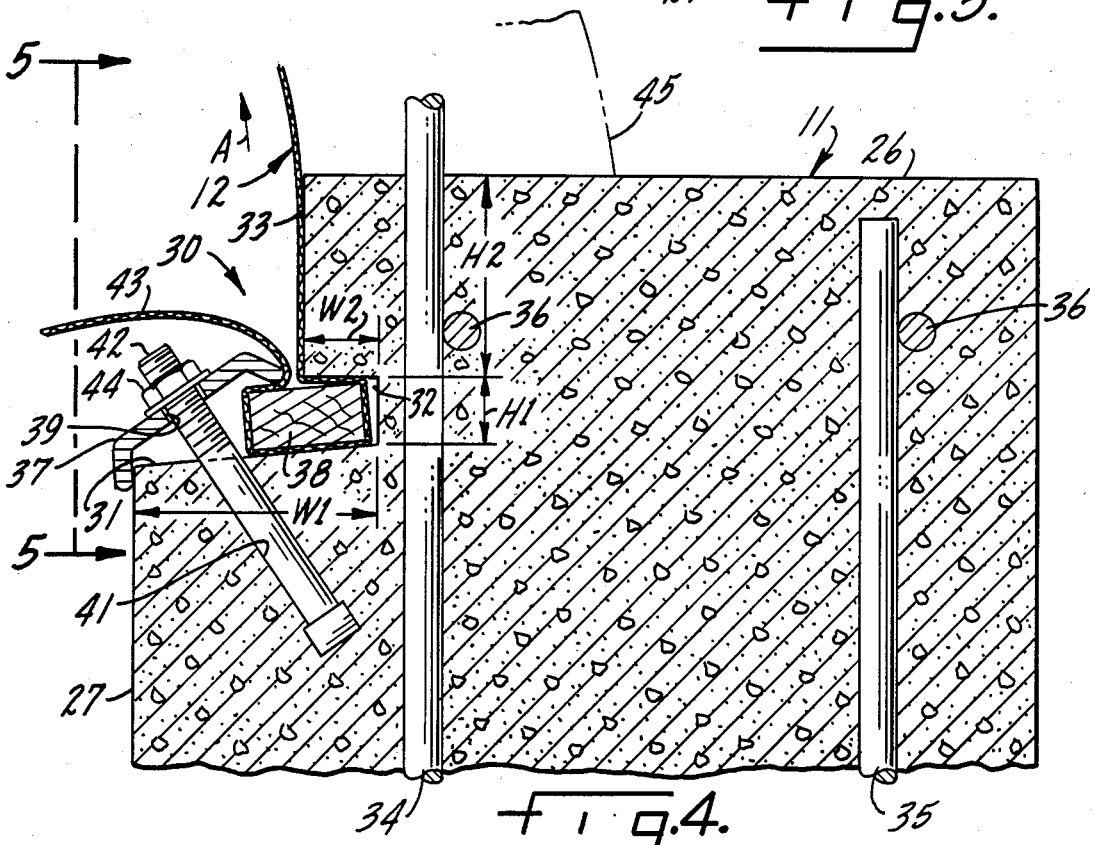
Fig. 4.
Fig. 6.
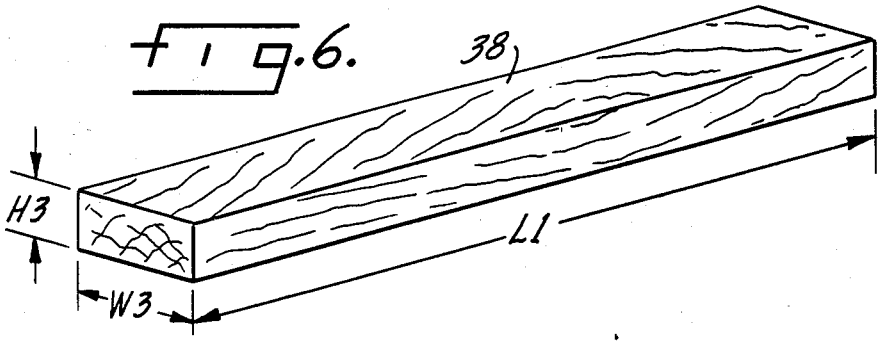

METHOD AND APPARATUS UTILIZING INFLATABLE MEMBRANE FORM FOR CONSTRUCTION OF CONCRETE SHELL BUILDING

BACKGROUND OF THE INVENTION

Large concrete shells are being utilized increasingly as roof structures for various types of buildings. Most frequently, these are storage buildings incorporating concrete shells of dome-like configuration. The same type of construction has been used in other buildings, such as churches, requiring high interiors preferably free of pillars or other roof support structures.

The most successful technique for erection of a concrete shell utilizes a single membrane form much like an enormous tent. The form membrane is positioned over the base wall of a building and then inflated. Reinforcing steel mesh is deployed on the membrane form and concrete is then applied over the membrane surface. The membrane form is removed when the concrete is set, and may be employed again for another building.

Another known technique employs a two-layer inflatable membrane form mounted on a frame. The frame is aligned between two building base walls, the membrane form is inflated, reinforcing steel is positioned on the form, and concrete is then deposited on the form surface. After the concrete sets, the form is deflated and the frame assembly is moved to a new position to form a further segment of the total shell. This segmental construction technique is described in Harrington U.S. Pat. No. 3,619,432.

In the use of inflatable membrane forms for the erection of concrete shells, a difficult continuing problem lies in the necessity for securing and sealing the edges of the form membrane to a building base wall or to a form support structure positioned immediately adjacent the base of the building. If the edges of the form membrane are anchored by retaining strips that use nails, bolts, or other like fasteners, tearing of the membrane is a frequent problem, particularly if the membrane form is used repeatedly in constructing a multi-segment shell or in the construction of a plurality of individual shells. Moreover, such conventional fasteners make it difficult to remove the form membrane for subsequent reuse without damage to the membrane.

One example of a technique that avoids the use of conventional fasteners in anchoring an inflatable membrane form for construction of a concrete shell is Neff U.S. Pat. No. 2,388,701. In the Neff patent, the concrete base of a building is poured with an outwardly projecting external ledge at its top. The membrane form extends down into the resulting groove around the periphery of the building and is anchored by bands encircling the entire building. While this arrangement avoids the use of nails, screws, or similar fasteners, it has a distinct disadvantage in that it is limited to buildings with exterior walls of circular or other smoothly curved configuration because any corner on the wall almost inevitably leads to tearing of the membrane form when the anchoring bands are tightened, with potentially disastrous results. The Neff anchoring arrangement is impractical and unusable in buildings of even moderate size because it is virtually impossible to align the membrane form accurately with the groove around the building and to tighten the retaining bands evenly around the complete building. In addition, with this arrangement it is difficult to remove the inflatable membrane form for reuse and removal of the form leaves an open channel around the building periphery.

A clamp assembly used successfully for a number of years in anchoring the edge portion of an inflatable membrane form in construction of a concrete shell is described in Harrington U.S. Pat. No. 3,719,341. That clamp assembly comprises a metal channel mounted on and facing outwardly of a support at the base of the shell; the support is usually the base wall for the building. A wood rail is wrapped in the edge portion of the form membrane and then inserted into the longitudinal opening of the channel. In the embodiment most used commercially, an auxiliary wood rail is also positioned within the channel. That clamp assembly is useful and effective because it requires no nails, screws, or like fasteners. The tension on the membrane produced when the form is inflated helps to hold the rails and the membrane edge in the clamp channel. When the form is deflated, on the other hand, the form membrane can be released from the clamp channel for reuse.

The clamp assembly of Harrington U.S. Pat. No. 3,719,341, however, has some disadvantages. When the form membrane is being secured to the clamp assemblies, close cooperative effort is required between two workmen, one working on the inside of the inflatable form and the other on the outside. If these two workmen are not effective in coordinating their efforts, substantial time can be lost, and the edge portion of the form membrane may be damaged. The form membrane, when inflated, extends back over the top of the clamp channel at an acute angle; if inflation produces tension in a direction outwardly of the longitudinal opening of the channel, the edge portion of the form may be pulled out of the channel. The clamp assembly also presents some difficulty when the concrete shell has set and removal of the form membrane is desired because the concrete at the rim of the shell usually covers the channel opening, making it necessary to remove the entire clamp assembly before the edge of the membrane can be disengaged from the clamp.

Yet another releasable clamp assembly for an inflatable membrane form is described in Harrington U.S. patent application Ser. No. 361,521 filed Mar. 24, 1985 and corresponding to British Patent No. 2,118,608B. That clamp assembly comprises a steel channel mounted at the base of the building, with the channel opening facing upwardly; a guide lip on one leg of the channel projects a short distance over the channel opening. A first rectangular wood rail wrapped in an edge portion of the membrane form is inserted into the channel in a loose fit; a second rectangular wood rail inserted into the top of the channel tightly fills the channel opening immediately below the guide lip and releasably clamps both rails and the edge portion of the membrane form into the channel.

This anchoring arrangement for the inflatable membrane form is substantially better than prior techniques, but there are still substantial problems. The steel channels and the steel mounting members required to secure those channels to the building base are expensive, heavy, and awkward to store. Insertion of the two wood rails into the steel channel is a difficult task, one which the workmen dislike. Furthermore, due to the usual irregularities in the top surface of a building base wall, this form anchoring arrangement is difficult to seal against air leakage when the form is inflated. In addition, when used with large inflatable membrane forms that apply heavy stresses to the clamp steel, there is a tendency for the steel to pull out the bolts employed to mount it on the base wall, particularly since it is usually undesirable to wait for complete curing of the concrete in the base wall prior to erection of the shell. These latter two difficulties apply equally to the clamp arrangement of the earlier Harrington Pat. No. 3,719,432.

SUMMARY OF THE INVENTION

It is an object of the present invention, therefore, to provide a new and improved method and apparatus for anchoring an inflatable membrane form used in construction of a large concrete shell that requires only simple and inexpensive metal components that may be easily and conveniently stored between jobs, yet affords a strong anchorage for the form even when used on a base wall that is only partially cured.

Another object of the invention is to provide a new and improved method and apparatus for utilization of an inflatable membrane form in construction of a large concrete shell that affords improved continuous sealing contact between the membrane form and the base of the building, minimizing or eliminating air leakage around the base when the form is inflated.

A further object of the invention is to provide a new and improved method and apparatus for anchoring an inflatable membrane form used in construction of a large concrete shell that minimizes labor and other costs while assuring a firm, uniform anchorage for the form at the periphery of the base of the building, that will not separate from the building base even if that base is incompletely cured concrete.

Accordingly, in one aspect the invention relates to a form assembly for use in constructing a concrete shell for a building of the kind comprising a base wall enclosing the perimeter of a building space and a concrete shell covering that building space. The form assembly comprises a membrane form support aligned with and extending along the top of the inner face of the base wall, the form support affording an elongated groove formation facing inwardly of the wall toward the building space; the groove formation includes, in sequence starting at its inner surface, a substantially horizontal shelf of width W1 constituting a minor fraction of the base wall thickness, a recess of height H1 and width W2, and a vertical wall segment of height H2, with W1>W2. An inflatable membrane form covers the building space. A multiplicity of elongated rail members each having a height H3 slightly smaller than H1 and a width W3 such that W1>W3>W2 are employed, each rail member wrapped in a segment of the edge portion of the membrane form with the rail member supported on the shelf and inserted into the recess. The form assembly further comprises a multiplicity of elongated metal retainer plates and retainer plate mounting means, affixed to the part of the base wall affording the shelf, for mounting the metal retainer plates on that part of the base wall, with each retainer plate engaging an outer segment of the edge portion of the membrane form wrapped around a rail member to anchor the rail members and the edge portion of the membrane form to the form support.

In another aspect the invention relates to a method of installing an inflatable membrane form for construction of a building of the kind comprising a base wall enclosing the perimeter of a building space and a concrete shell covering that building space, comprising the steps of:

A. erecting a base wall with a groove formation formed as an integral part of the top of the inner face of the base wall, facing inwardly of the wall toward the building space, the groove formation including, in sequence starting at the inner surface of the wall, a substantially horizontal shelf of width W1 constituting a minor fraction of the base wall thickness, a recess of height H1 and width W2, and a vertical wall segment of height H2, with W1>W2;

B. affixing retainer plate mounting means to the part of the base wall affording the shelf;

C. covering the building space with an inflatable membrane form in deflated condition;

D. wrapping the edge portion of the membrane form in a multiplicity of elongated rail members each having a height H3 slightly smaller than H1 and a width W3, such that W1>W3>W2;

E. inserting each wrapped rail member into the recess in the groove formation;

F. utilizing the retainer plate mounting means to mount a multiplicity of metal retainer plates on the part of the base wall affording the shelf, with each retainer plate engaging an outer segment of the edge portion of the membrane form wrapped around a rail member to anchor the rail members and the edge portion of the membrane form to the base wall; and G. thereafter inflating the membrane form.

BRIEF DESCRIPTION OF THE DRAWINGS

FIG. 3 is a detail sectional view, on an enlarged scale, taken approximately as indicated by line 3—3 in FIG. 1, but at a stage of construction prior to that illustrated in FIG. 1;

FIG. 4 is a detail sectional view corresponding to FIG. 3 but taken at the same stage of construction for the building as shown in FIG. 1;

FIG. 5 is a detail view taken from the building interior, approximately as indicated by line 5—5 in FIG. 4; and FIG. 6 is a perspective view of a wood rail member used in the construction shown in FIGS. 4 and 5.

DESCRIPTION OF THE PREFERRED EMBODIMENT

Figure 1:
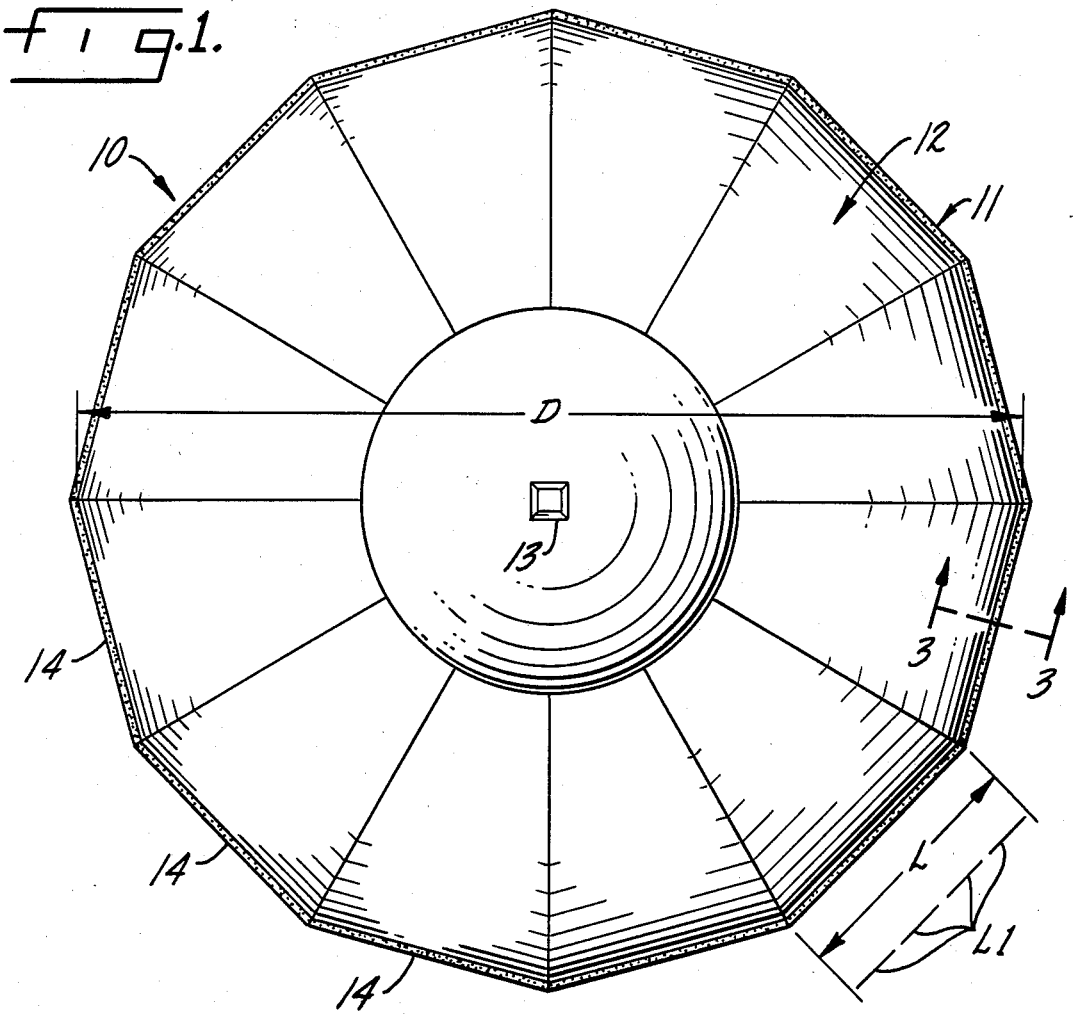
FIG. 1 is a plan view of a large concrete shell building at an intermediate stage of construction with the interior space of the building covered by an inflated membrane form ready for placement of reinforcing steel and subsequent deposit of concrete on the form.
Figure 2:
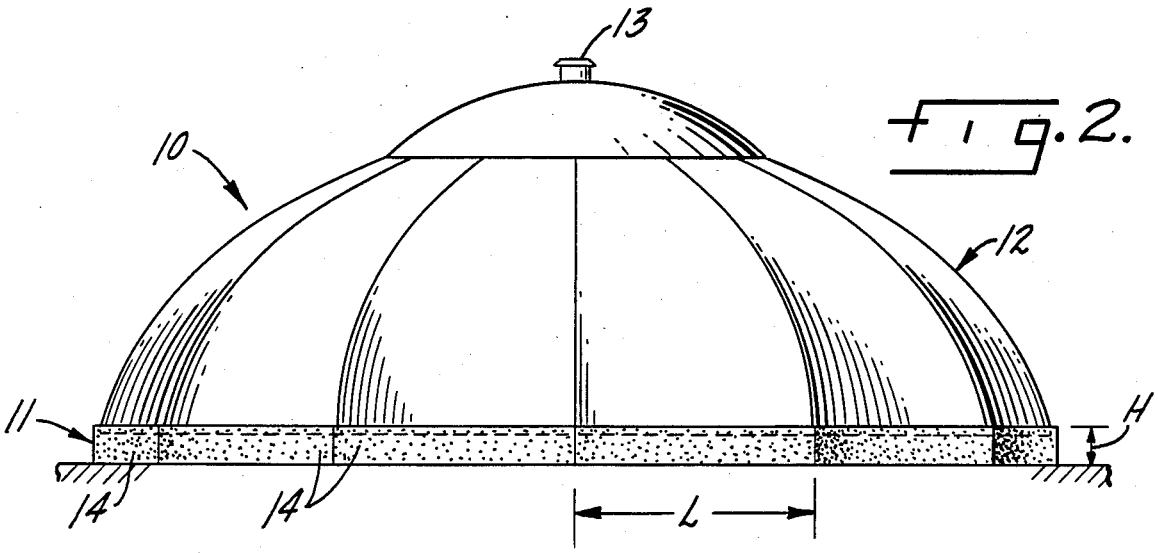
FIG. 2 is an elevation view of the building of FIG. 1 at the same intermediate stage of construction.

FIGS. 1 and 2 illustrate a large building 10 of the kind comprising a base wall 11 enclosing the perimeter of an interior building space and a concrete shell covering that building space. Building 10 is shown at an intermediate stage of construction with the interior space of the building covered by an inflated membrane form 12 ready for placement of reinforcement steel and subsequent deposit of concrete on the form. Building 10 is of a type frequently employed for storage but having other uses. The peripheral configuration of building 10 is approximately circular but base wall 11 actually constitutes a series of linear chords 14 so that the shape is that of a multi-sided regular polygon. This particular configuration materially reduces the overall cost of the building because the linear chords 14 permit the use of conventional, inexpensive linear concrete forms when constructing base wall 11. The membrane form 12 is shown in inflated condition with a ventilator 13 mounted in the top center portion of the form.

The overall effective interior diameter D (FIG. 1) of building 10 may vary substantially depending upon the size and capacity required for building 10. Typically, each of the chord sections 14 of base wall 11 has a length L of fifteen feet six inches. As illustrated, building 10 includes a base wall of twelve chords 14 and has an interior diameter D of approximately sixty feet. For a building having an interior diameter D of ninety feet, the base wall is formed with eighteen chord segments 14 of the same length L. For an interior diameter D of approximately one hundred fifty feet, the number of chord segments 14 in base wall 11 is increased to thirty. The overall height of building 10 is also subject to substantial variation and is determined by the configuration of membrane form 12.

As thus far described, building 10 is essentially conventional and corresponds to a number of buildings previously erected in the United States and elsewhere. The basic construction technique has been described in different publications, including the journals *Public Works Magazine,* October, 1978 and *Farm Chemicals,* May, 1982. The present invention is based upon the method and apparatus employed to anchor membrane form 12 to base wall 11 around the periphery of building 10 as described in connection with FIGS. 3–6.

FIG. 3 illustrates an early step in the construction of the base wall 11 for building 10. In accordance with the present invention, base wall 11 incorporates a groove formation preferably formed as an integral part of the top of the inner face of the base wall, with the groove formation facing inwardly of the wall toward the interior building space. To achieve the desired configuration, an elongated groove former 15 is affixed to and extends along the top part of the form member 16 employed in the construction of wall 11. Groove former 15 may be fabricated of sheet metal, bent to the illustrated configuration, with a top wall 17, a depending side wall 18, a horizontally extending recess wall 19, a depending recess side wall 21, and a bottom or shelf wall 22. The external dimensions of groove former 15 are such that the width W1 of its shelf wall 22 is substantially larger than the width W2 of recess wall 19. Preferably, the height H1 of groove former recess side wall 21 is substantially smaller than the height H2 of groove former wall 18. A wood support member 23, which may be an ordinary wood two by four, is mounted in the outer open portion of groove former 15 by suitable means such as the nails 24. This provides for convenient mounting of groove former 15 on the wall form member 16 by appropriate means such as a series of double headed nails 25. The top wall 17 of groove former 15 is aligned at a height on form 16 that corresponds to the desired level for the top surface 26 of base wall 11.

The overall length of groove former 15 could be made to correspond to the length L of each chord 14 for building 10 (FIG. 1). Usually, however, it is more convenient to fabricate groove former 15 in lengths of approximately eight feet, overlapping the two lengths of groove former at the center of each chord in erecting base wall 11. It is not essential that groove former 15 be formed of sheet metal. An extruded plastic groove former may also be utilized if desired, provided the plastic employed is of adequate strength. The sloping configuration shown for walls 19 and 22 of groove former 15 facilitate removal of the groove former from wall 11.

When base wall 11 has been poured and the concrete is partially cured, form member 16 is removed from the wall and groove former 15 is also removed, leavin9 base wall 11 with the configuration shown in FIG. 4. The sections of groove former 15 are frequently in good enough condition for subsequent use in construction of another building.

As seen in FIG. 4, the top inner face of base wall 11 has a groove formation generally indicated by reference numeral 30 that includes, in sequence starting at the inner surface 27 of the wall, a substantially horizontal shelf 31 of width W1 that is a minor fraction of the overall thickness of the base wall, a recess 32 of height H1 and width W2, and a vertical wall segment 33 of height H2. The shelf segment width W1 is substantially larger than the recess width W2. Preferably, the recess height H1 is substantially smaller than the height H2 of vertical wall segment 33. Wall 11 includes the usual reinforcing bars 34 and 35; the vertical re-bars 34 preferably extend above the top surface 26 of wall 11 to anchor a concrete shell to the base wall. Wall 11 may also include horizontally extending reinforcements or tendons 36.

To anchor membrane form 12 on base wall 11, a multiplicity of elongated metal retainer plates 37 and a multiplicity of elongated wood rail members 38 are employed. First, however, mounting means for mounting the retainer plates 37 on the part of base wall 11 affording the groove formation shelf 31 must be provided. To this end, wood rails 38 are inserted into the recesses 32 in groove formation 30 around the interior periphery of base wall 11. Each rail 38 (FIG. 6) has a height H3 smaller than the height H1 of recess 32, so that the rail fits easily into the recess. Each rail 38 has a width W3 that is larger than the recess width W2 but appreciably smaller than the shelf width W1 so that the rail fits into but projects from recess 32 as shown in FIG. 4. At this juncture, form 12 is not present.

The metal retainer plates 37 are preferably formed from ten gauge steel with the edges bent downwardly at obtuse angles as shown in FIG. 4. Thus, each retainer plate 37 is of open, flat, generally C-shaped cross sectional configuration. Retainer plates 37 preferably have approximately the same length L1 as rails 38, FIG. 6; for convenience of use by the construction workmen, length L1 may be approximately forty-five inches so that four retainer plates 37 and four rails 38 are used along each chord 14 of building 10 (FIG. 1).

Each retainer plate 37 has a series of holes 39 drilled or cut into the plate. With rails 38 in place in recesses 32, each retainer plate 37 is used as a template for drilling a corresponding series of holes 41 through shelf 31 into base wall 11. Retainer plates 37 and rails 38 are then removed and a multiplicity of expansion bolts 42 are installed in holes 41. The threaded upper ends of bolts 42 project upwardly from shelf 31 as shown in FIG. 4.

For construction of the concrete shell to cover base wall 11 and complete the exterior of building 10, the inflatable membrane form 12 is now spread over the building space within wall 11, in deflated condition. At this juncture, the edge portion 43 of membrane form 12 is wrapped around the multiplicity of elongated rail members 38. To aid the construction workmen in locating rail members 38 in the edge portion 43 of form 12, the membrane form is marked in advance with a clamp location line. Rails 38, as they are wrapped in the edge portion 43 of form membrane 12, are each inserted into the recess 32 in groove formation 30 as shown in FIGS.

4 and 5. Each retainer plate 37 is then mounted on its mounting bolts 42 and a nut 44 is threaded onto each mounting bolt 42. As seen from FIGS. 4 and 5, one edge of each retainer plate 37 engages an outer segment of the edge portion 43 of membrane form 12 that has been wrapped around one of the rail members 38; the other edge of each retainer plate 37 engages the inner face 27 of wall 11. Thus, plates 37 anchor the rail members and the edge portion 43 of membrane form 12 to base wall 11 along the entire periphery of the membrane form.

At this point, nuts 44 are tightened only to a limited extent. Air is then pumped under pressure into the interior space of the building encompassed by base wall 11, below form 12, inflating and elevating the membrane form as shown in FIGS. 1 and 2. As tension increases on form 12, as indicated in FIG. 4 by arrow A, minor misalignments in the membrane form tend to straighten out. Limited slippage of form 12 relative to base wall surface 33 and rails 38 is permitted because of the limited tightening of nuts 44. Once form 12 is fully inflated, nuts 44 may be further tightened to assure firm anchorage of the membrane form on base wall 11.

The shell form assembly is now complete and ready for placement of steel mesh reinforcement (not shown) on the form membrane and for deposit of concrete to form the shell. The concrete is usually applied in two or three layers to a total thickness of three inches or more as indicated generally in FIG. 4 by phantom line 45. As can be seen from FIG. 4 form membrane 12 engages the vertical wall 33 of groove formation 30 around the entire periphery of the building so that there is no necessity for taping or other steps to seal the form membrane against air leakage at its juncture with the base wall.

When the concrete shell has been deposited on form 12 and has cured sufficiently to be self-supporting the construction workmen remove retainer plates 37 and rails 38. The membrane form is then pulled out of reces 32 along each chord 14 of the building and the form is removed, ready for use in erection of another building.

Typical dimensions for a practical form assembly method and apparatus as described and illustrated are:

L=15 feet 6 inches
L1=45 inches
W1=$3\frac{1}{4}$ inches
W2=1 inch
W3=$1\frac{1}{2}$ inch
H1=$\frac{7}{8}$inch
H2=$2\frac{1}{2}$ inch
H3=$\frac{3}{4}$ inch
Bolts 42—$\frac{1}{2}$ inch by $4\frac{1}{2}$ inches
Retainer plates 37 from $3\frac{1}{2}$ inch wide 10 gauge steel To avoid excessive delays in constructing building 10, it is usually necessary to proceed with construction of the roof shell before the concrete of base wall 11 is fully matured. That is the concrete of wall 11 is usually rather "green" when membrane form 12 is mounted on wall 11 and inflated. This could lead to failure of the anchorage for the membrane form if the full upward tension load of the inflated membrane form were carried by clamp mounting bolts, as in the Harrington channel clamps referred to above; the bolts pull out of the green concrete. In the form assembly of the present invention, however, this lifting stress is transferred directly to the projecting wall ledge 33 above recess 32. Consequently, the load capacity of the form assembly is substantially improved as compared with prior channel-clamp arrangements.

The form assembly method and apparatus of the invention require only simple and inexpensive metal components, primarily the retainer plates 37, that are easily and conveniently stored between jobs. They afford an effective, continuous seal between membrane form 12 and base wall 11, avoiding air leakage around the base when form 12 is inflated. Labor and other costs are effectively minimized.

We claim:

1. A form assembly for use in constructing a concrete shell for a building of the kind comprising a base wall enclosing the perimeter of a building space and a concrete shell covering that building space, the form assembly comprising:

a membrane form support aligned with and extending along the top of the inner face of the base wall, the form support affording an elongated groove formation facing inwardly of the wall toward the building space, the groove formation including, in sequence starting at its inner surface, a substantially horizontal shelf of width W1 constituting a minor fraction of the base wall thickness, a recess of height H1 and width W2, and a vertical wall segment of height H2, with W1>W2;

an inflatable membrane form covering the building space;

a multiplicity of elongated rail members each having a height H3 slightly smaller than H1 and a width W3 such that W1>W3>W2, each rail member wrapped in a segment of the edge portion of the membrane form with the rail member supported on the shelf and inserted into the recess;

a multiplicity of elongated metal retainer plates;

and retainer plate mounting means, affixed to the part of the form support affording the shelf, for mounting the metal retainer plates on that part of the form support with each retainer plate engaging an outer segment of the edge portion of the membrane form wrapped around a rail member to anchor the rail members and the edge portion of the membrane form to the form support.

2. A form assembly for a concrete shell building according to claim 1 in which the form support constitutes the base wall of the building and the groove formation is formed as an integral part of the top of the inner face of the base wall.

3. A form assembly for a concrete shell building according to claim 2 in which the retainer plate mounting means comprises a multiplicity of mounting bolts each mounted in and projecting upwardly from the shelf of the groove formation.

4. A form assembly for a concrete shell building according to claim 3 in which the base wall is a concrete wall.

5. A form assembly for a concrete shell building according to claim 1 in which the retainer plate mounting means comprises a multiplicity of mounting bolts each mounted in and projecting upwardly from the shelf of the groove formation.

6. A form assembly for a concrete shell building according to claim 1 in which each retainer plate is of flat, open, C-shaped cross-sectional configuration.

7. The method of installing an inflatable membrane form for construction of a building of the kind comprising a base wall enclosing the perimeter of a building space and a concrete shell covering that building space, comprising:

A. erecting a base wall with a groove formation formed as an integral part of the top of the inner face of the base wall, facing inwardly of the wall toward the building space, the groove formation including, in sequence starting at the inner surface of the wall, a substantially horizontal shelf of width W1 constituting a minor fraction of the base wall thickness, a recess of height H1 and width W2, and a vertical wall segment of height H2, with $W1 > W2$;

B. affixing retainer plate mounting means to the part of the base wall affording the shelf;

C. covering the building space with an inflatable membrane form in deflated condition;

D. wrapping the edge portion of the membrane form in a multiplicity of elongated rail members each having a height H3 slightly smaller than H1 and a width W3, such that $W1 > W3 > W2$;

E. inserting each wrapped rail member into the recess in the groove formation;

F. utilizing the retainer plate mounting means to mount a multiplicity of metal retainer plates on the part of the base wall affording the shelf, with each retainer plate engaging an outer segment of the edge portion of the membrane form wrapped around a rail member to anchor the rail members and the edge portion of the membrane form to the base wall; and G. thereafter inflating the membrane form.

8. The method of installing an inflatable form membrane for construction of a concrete shell building according to claim 7 in which the retainer plate mounting means of step B comprises a multiplicity of mounting bolts, at least two mounting bolts for each retainer plate, and in which the mounting bolts are installed in and project upwardly from the shelf.

9. The method of installing an inflatable form membrane for construction of a concrete shell building according to claim 8 in which the mounting bolts are expansion bolts and the retainer plates are employed as templates for drilling holes into the shelf for installation of the mounting bolts in step B.

10. The method of installing an inflatable form membrane for construction of a concrete shell building according to claim 9 in which the rail members are inserted in the groove formation recess during use of the retainer plates as templates in step B.

11. The method of installing an inflatable form membrane for construction of a concrete shell building according to claim 7 in which the base wall is a concrete wall poured in situ and in which an elongated groove former having the configuration specified in step A is mounted in the top inner portion of a wall form to mold the groove formation into the base wall as an integral part thereof.

* * * * *